United States Patent [19]

McKinley

[11] 4,386,342

[45] May 31, 1983

[54] INTRUSION ALARM SYSTEM

[76] Inventor: Alexander T. McKinley, 3 Amanda Rd., Camps Bay, Cape Town, Cape Province, South Africa

[21] Appl. No.: 249,745

[22] Filed: Mar. 31, 1981

[30] Foreign Application Priority Data

Apr. 1, 1980 [ZA] South Africa ..... 80/1928

[51] Int. Cl.[3] ..... G08B 13/20; G08B 13/08

[52] U.S. Cl. ..... 340/544; 340/528; 340/648

[58] Field of Search ..... 340/544, 648, 528

[56] References Cited

U.S. PATENT DOCUMENTS

| | | | |
|---|---|---|---|
| 3,289,192 | 11/1966 | Davey | 340/544 |
| 3,833,895 | 9/1974 | Fecteau | 340/528 |
| 3,934,239 | 1/1976 | Mason et al. | 340/648 |
| 3,947,838 | 3/1976 | La Forge, Jr. | 340/544 |

FOREIGN PATENT DOCUMENTS

| | | | |
|---|---|---|---|
| 2247717 | 5/1975 | France | 340/544 |

*Primary Examiner*—Glen R. Swann, III

*Attorney, Agent, or Firm*—Curtis, Morris & Safford

[57] ABSTRACT

An alarm system comprises a blower driven by an electric motor, the blower being fitted to the premises to be protected and serving to blow air into the premises. With all doors and windows shut the blower supplies a steady flow of air, the flow rate depending on the nature of the blower and how fast air can leak out of the premises around doors and windows, through air vents etc. The current drawn by the motor is constant in these circumstances and is monitored. When entry is made to the premises, by opening a door or window, the air flow rate increases and the load on the motor changes. This is reflected in a change in the current drawn by the motor and the blower can blow air from the premises, air entering around doors and windows etc.

5 Claims, 3 Drawing Figures

INTRUSION ALARM SYSTEM

BACKGROUND OF THE INVENTION

This invention relates to an alarm system.

Alarm systems are known which rely on a blower to increase or decrease the pressure inside the premises to be protected by blowing air into or out of the premises. A pressure sensitive switch detects the change in pressure which results from a door or window being opened and activates the alarm. Such alarms have never been a great success commercially as the sensitivity of the switch results in false alarms. For example, a sudden gust of wind across or against one wall of the premises can change the pressure sufficiently to activate the alarm. Many attempts have been made to overcome this problem and, in one known form of alarm system, a cyclically varying pressure is created in the premises. This can be done by cyclically reversing the motor of the blower or by means of a moving door or paddle. The varying pressure is used to create a modulated electrical signal. Deviations of the modulated signal from its norm are used to activate the alarm. Applicant is not aware of this system having been used commercially and attributes this to its complexity.

In another known system a solid-state thermal flowmeter detects changes in flow rate through a tube connecting the premises to be protected to the atmosphere. The sensitivity required of the flow meter to enable it to detect that the premises have been opened renders the system prone to giving false alarms due to changes in prevailing conditions which have nothing to do with entry into the premises e.g. temperature changes, wind gusts etc.

OBJECTS OF THE INVENTION

An object of the present invention is to provide an alarm system incorporating a blower and a reliable and simple means of determining when entry has been made to the premises protected by the system.

Another object of the present invention is to provide an alarm system incorporating a blower and a means of determining when entry has been made to the premises which means is not prone to giving false alarms.

SUMMARY OF THE INVENTION

According to one aspect of the present invention there is provided an alarm system for indicating that entry has been made into closed premises, the alarm system comprising a blower, an electric motor for driving the blower, means for monitoring the current being drawn by the motor, means for detecting the change in motor current which occurs upon there being a change in the load on the motor, and an alarm activated by the detecting means.

In one form of the system said monitoring means generates an electric field, and the change in the strength of the field which occurs upon there being a change in motor current is detected.

In another form the monitoring means includes means for generating a voltage proportional to the current being drawn by the motor, and said detecting means includes means for determining if said proportional voltage lies within the limits represented by said reference voltages.

There can be timing means for delaying activation of said alarm for a predetermined period after a change in motor current is detected. The system can also include means operable by the user to arm the system, and timing means for delaying arming of the system for a predetermined time after operation of the arming means. In this form the system can also include means for activating the alarm in response to a change in the condition of the arming means to the disarmed condition, timing means for delaying activation of the alarm for a predetermined period after such change in the condition of the arming means to the disarmed condition, and manually operable means for operation during the delay period for preventing the alarm being activated.

To render the system independent of the mains supply for a period of time after a mains power failure, it can include a battery and a rectifier for supplying current to power said motor and maintain the battery charged.

Where the motor is a D.C. motor there can be a voltage regulator between said motor on the one hand and the battery and rectifier on the other. Alternatively, where the motor is an A.C. motor there can be an inverter between the motor on the one hand and the battery and rectifier on the other.

According to another aspect of the present invention there is provided a method of protecting closed premises which comprises creating a flow of air through a bounding wall of the premises by means of a blower driven by an electric motor, monitoring the current being drawn by the motor, detecting the change in motor current which occurs upon there being a change in load on the motor stemming from a change in the pneumatic resistance imposed on said blower when the premises are opened, and activating the alarm upon such change being detected.

BRIEF DESCRIPTION OF THE DRAWINGS

For a better understanding of the present invention, and to show how the same may be carried into effect, reference will now be made, by way of example, to the accompanying drawings in which.

DESCRIPTION OF PREFERRED EMBODIMENTS

Figure 1:
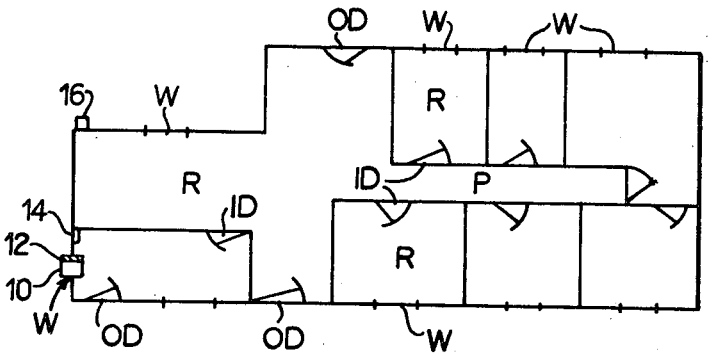
FIG. 1 is a diagrammatic plan of a house.

Referring firstly to FIG. 1, the house illustrated has a number of rooms R, a passage P and a number of outside doors OD. Inside doors are marked ID and windows W.

The reference numeral 10 designates a blower driven by an electric motor 12 which is incorporated into the casing of the blower 10. Reference numeral 14 designates a control unit for the system. An alarm, in the form of a bell and/or siren and/or flashing light, is shown at 16.

The blower can be mounted in a window or in an aperture in an outside wall.

A main switch for the system is shown at 18 (FIG. 2), and this is controlled by a key operated lock 20. When the switch 18 is open the entire system is de-energised.

The motor 12 is connected between the electrical supply lines 22 and 24 in series with a current transformer 26 and an ampmeter 28. Reference numeral 30.1 designates the contacts of a contactor which is an integral part of the motor 12, and 30.2 designates the coil of the contactor.

A current sensitive relay 32 is also connected across the lines 22 and 24 and it will be noted that said coil 30.2 of the contactor is connected between the relay 32 and the line 24.

A timer is shown at 34, the contacts of the timer 34 being designated 36 and being connected in the line between the current transformer 26 and the relay 32.

A further timer 38 is connected between the relay 32 and the line 24 and there is a warning light 40 in parallel with the timer 38. The contacts of the timer 38 are shown at 42 and are in series with the alarm 16.

In use of the alarm system, all the windows and outside doors of the premises to be protected are closed. As the person locking up is about to leave the premises, he closes the switch 18 by means of his key. Immediately he does this the contactor closes to energise the motor 12. Air is thus blown into, or out of, the premises. Once the outside door has been closed the blower reaches a steady state. Obviously, the premises are not airtight and the blower displaces an amount of air which depends on how rapidly air can flow in chimneys, under doors and around window frames. However, within a short period of time the blower settles down to a steady state. After a predetermined delay, the timer 34 operates and closes the contacts 36. Thus the current transformer 26 is now connected to the relay 32.

As soon as a door or window is opened, or a window is broken, or entry is forced through ceiling, floor or wall, the rate of airflow into or out of the premises alters. The current drawn by the motor 12 changes accordingly. The transformer 26 continually monitors the current being drawn by the motor and this change in current is detected by the relay 32. When the relay 32 is actuated, the contactor contacts 30.1 open to disconnect the motor 12 from the supply. Simultaneously, the timer 38 is energised. After a predetermined delay, the contacts 42 close and the alarm 16 is activated. Simultaneously, if desired, an automatic connection to a security service or the local police can be made.

The purpose of the two timers is to permit authorised exit from and entry to the premises without activating the alarm. The delay caused by the timer 34 enables the person locking-up to energise the alarm system and leave the premises before the detector constituted by the relay 32 is connected into the circuit. The delay caused by the timer 38 permits a person making an authorised entry to the premises to reach the control unit 14 and open the main switch 18 by means of his key before the alarm is activated.

Should the person closing the premises have failed to shut a window or door, then the airflow rate through the blower will be in excess of the amount for which the system has been set. This means that the current detected by the transformer 26 will be higher than normal and consequently, immediately the contacts 36 close, the sequence of events which follows entry into the premises will be initiated and the alarm will be energised.

All or some part of the premises can be protected. If only part of the premises is protected then opening of an inside door from the protected part to another part will have the effect of actuating the alarm.

If the blower is arranged to draw air from outside the premises then a heating element can be provided so that the air entering is warmed during its passage through the blower.

The timers, current transformer, relay and main switch constitute the unit 14.

Where the air is blown from the premises, a heat detector can be incorporated into the blower. This detects any increase in temperature in the air being withdrawn and hence can indicate the presence of a fire.

Figure 3:
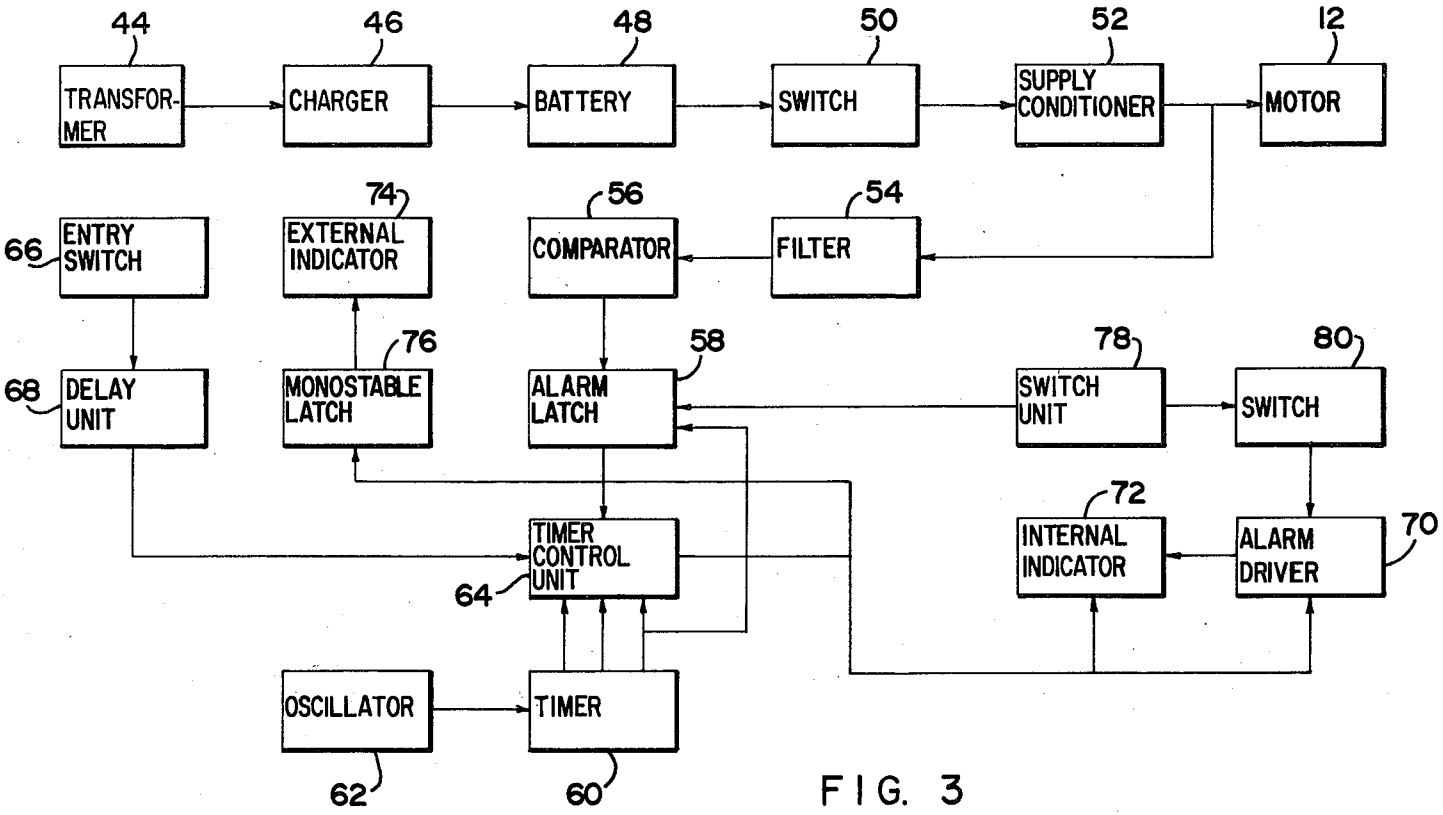
FIG. 3 is a block diagram of a modified alarm system according to the present invention.

In the alarm system of FIG. 3, a mains transformer 44 supplies a controlled battery charger 46 which is in turn connected to a battery 48. The battery 48 is normally in a 'floating' condition in that, while the mains remain 'on' it does not supply power to the circuit. It is, however, maintained fully charged by a trickle current when necessary. The charger 46 provides a constant voltage and the current it can supply is limited.

Figure 2:
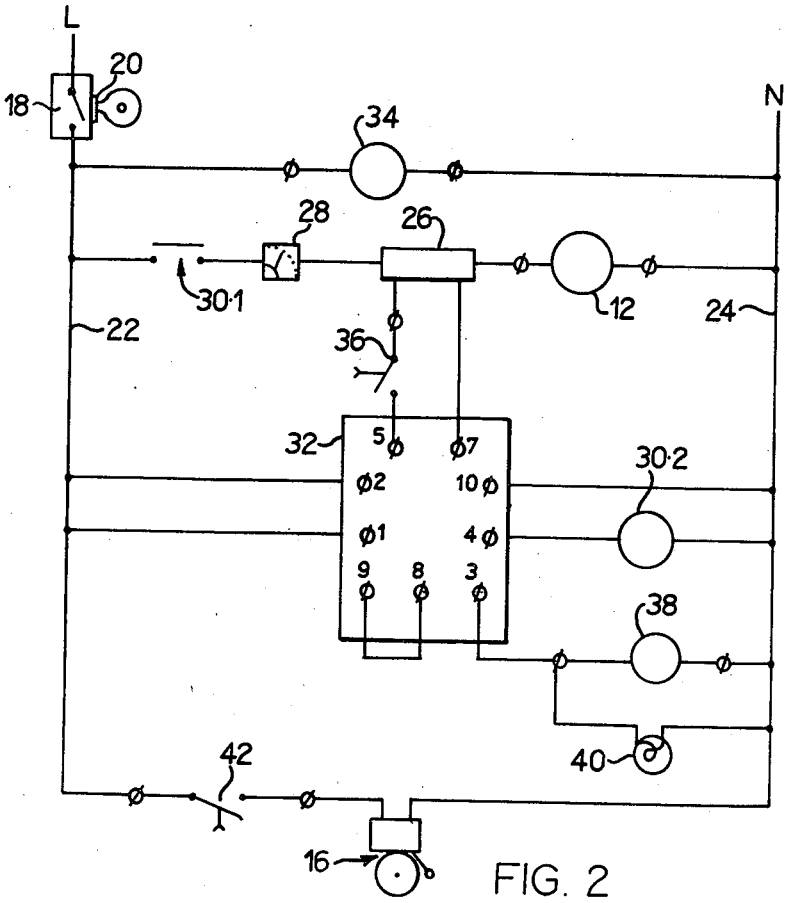
FIG. 2 is a circuit diagram of an alarm system according to the present invention.

The motor is, as in FIGS. 1 and 2, designated 12 and an on-off switch therefor is designated 50. The block 52 designates a supply conditioner which produces an output the nature of which depends on the type of motor being used. For example, the unit 52 can be a D.C. regulator or can be an inverter providing current at a frequency suitable for A.C. motors.

A filter unit 54 averages out the current wave form and produces a proportional voltage which is used to monitor the load condition of the motor 12. The proportional voltage is compared in the comparator block 56 with upper and lower reference voltages. If the monitored voltage is outside the limits represented by the reference voltages then an output signal is fed to the monostable alarm latch 58 which, once triggered, remains in its new condition.

A timer 60 driven by an oscillator 62 is connected to a timer control unit 64.

A key operated entry switch 66, which can be incorporated into one of the door locks of the premises, is connected through a switch condition detector and delay unit 68 to the timer control unit 64. The detector 68 supplies to timer unit 64 a signal indicating whether the switch 66 is open or closed.

The alarm (not shown) is connected to an alarm driver 70 and there is an indicator 72 comprising, for example, coloured lights, for indicating the status of the drive 70. The indicator 72 can be located internally of the premises and there can be an external indicator 74 connected through a monostable latch 76 to the indicator 72.

A switch unit 78 enables the system to be switched on and off, to be reset and to be tested as will be described. A further switch 80 is provided to enable the system to be tested without activating the driver 70. The switch 50 can also be incorporated into the unit 78 and can be overridden by the main on-off switch.

In use of the system, the switch 50 is generally left on and the system is prepared for use by closing the main on-off switch of the unit 78. The motor 12 is thus energised and commences to blow air into or out of the premises. A coloured light i.e. yellow of each of the indicators 72 and 74 shows that the system is on but not yet armed.

When the user leaves the premises he closes the switch 66 as he locks up. After a delay introduced by the unit 68, a signal from the unit 68 to the timer control unit 64 arms the system. Simultaneously, the yellow light of the indicators 72 and 74 is extinguished and another light e.g. a green one comes on to show that the system is armed.

Should an intruder enter the premises the comparator block 56 detects the abnormal change in current which result from the change in load on the fan motor 12. The alarm latch 58 is thus triggered whereupon, either immediately or after a suitable delay controlled by the setting of the timer unit 64, the driver 70 is energised to activate the alarm. The green lights go out and e.g. red warning lights of the internal and external indicators 72 and 74 come on.

When the user returns, he opens the switch 66 and the unit 68 signals the change in status of the switch 66 to the timer control unit 64. The unit 64 can be set to delay activation of the driver 70 for, say, 30 seconds. If the reset switch of the unit 78 is not depressed within the 30 seconds period then the driver 70 is activated. Thus should an intruder sabotage the switch 66, he would be able to enter the premises without immediately activating the driver 70. However, unless he could find and depress the reset switch within the 30 second period the alarm would still go off.

It will be understood that, in the embodiment of FIG. 3, opening of the premises results in immediate activation of the alarm whereas, in the form of FIGS. 1 and 2, there has to be a delay to permit re-set to take place. If desired, instead of monitoring a change in current, the rate of change of current could be detected. Thus drift in the current drawn by the motor over a period of time due to wear and other changes would not activate the alarm. However, the rapid rate of change resulting from a sudden change in load on the fan would be sufficient to activate the alarm.

I claim:

1. An alarm system for indicating that entry has been made into closed premises, the alarm system comprising a blower, an electric motor for driving the blower, means for monitoring the current being drawn by the motor and for producing an output signal which varies with changes in motor current, means connected to the monitoring means for detecting a change in said output signal and hence for detecting the change in motor current which occurs upon there being a change in the load on the motor, an alarm activated by the detecting means, means operable by the user to arm the system, means for activating the alarm in response to a change in the condition of the arming means to the disarmed condition, timing means for delaying activation of the alarm for a predetermined period after such change in the condition of the arming means to the disarmed condition, and manually operable means for operation during the delay period for preventing the alarm being activated.

2. An alarm system according to claim 1, in which said monitoring means generates an electric field, and the change in the strength of the field which occurs upon there being a change in motor current is detected.

3. An alarm system according to claim 1, in which said monitoring means includes means for generating a voltage proportional to the current being drawn by the motor, and said detecting means includes means for generating two reference voltages and comparator means for determining if said proportional voltage lies within the limits represented by said reference voltages.

4. An alarm system according to claim 1, and including timing means for delaying activation of said alarm for a predetermined period after a change in motor current is detected.

5. An alarm system according to claim 1, and which includes means operable by the user to arm the system, and timing means for delaying arming of the system for a predetermined time after operation of the arming means.

* * * * *